US009158256B2

(12) United States Patent
Takahashi

(10) Patent No.: US 9,158,256 B2
(45) Date of Patent: Oct. 13, 2015

(54) IMAGE FORMING APPARATUS

(71) Applicant: BROTHER KOGYO KABUSHIKI KAISHA, Nagoya-shi, Aichi-ken (JP)

(72) Inventor: Osamu Takahashi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 177 days.

(21) Appl. No.: 13/906,119

(22) Filed: May 30, 2013

(65) Prior Publication Data

US 2013/0336676 A1 Dec. 19, 2013

(30) Foreign Application Priority Data

Jun. 18, 2012 (JP) ..... 2012-136839

(51) Int. Cl.
*G03G 15/00* (2006.01)
*G03G 15/01* (2006.01)

(52) U.S. Cl.
CPC ..... *G03G 15/5041* (2013.01); *G03G 15/0194* (2013.01); *G03G 15/5062* (2013.01); *G03G 15/757* (2013.01); *G03G 2215/0161* (2013.01)

(58) Field of Classification Search
CPC ..... G03G 15/5041; G03G 15/5062; G03G 15/0194; G03G 2215/0161; G03G 15/757
USPC ..... 399/49, 72, 167
See application file for complete search history.

(56) References Cited

U.S. PATENT DOCUMENTS

2009/0058348 A1* 3/2009 Ryu ..... 318/639
2010/0303504 A1* 12/2010 Funamoto et al. ..... 399/167

FOREIGN PATENT DOCUMENTS

| | | | |
|---|---|---|---|
| JP | S62-018654 | A | 1/1987 |
| JP | H04-131872 | A | 5/1992 |
| JP | H05-188723 | A | 7/1993 |
| JP | 2001-005364 | A | 1/2001 |
| JP | 2004-069801 | A | 3/2004 |
| JP | 2006-058364 | A | 3/2006 |
| JP | 2006-084669 | A | 3/2006 |

* cited by examiner

*Primary Examiner* — Hoang Ngo
(74) *Attorney, Agent, or Firm* — Merchant & Gould PC

(57) ABSTRACT

An image forming apparatus includes: rotators; a drive motor configured to drive the plurality of rotators and including a hall element configured to output a hall signal according to a change of a magnetic field; a counter configured to count the hall signal; an image forming unit forming a color image on a recording medium; and a controller configured to function as: an acquiring unit controlling the image forming unit to form a test pattern on the recording medium, and acquiring correction information based on the formed test pattern; a phase managing unit managing the phases of the rotators based on a count value of the counter from the formation start timing; and a correcting unit correcting the positional deviation based on the phases which are managed by the phase managing unit, and the correction information acquired by the acquiring unit.

9 Claims, 10 Drawing Sheets

| CYCLE OF HP | REFERENCE [° ] | | | POST-REACTIVATION [° ] |
|---|---|---|---|---|
| | HP PHASE | FG PHASE | PHASE DIFFERENCE | PHASE DIFFERENCE |
| 0 | 0 | 0 | 8.5 | 2 |
| 1 | 45.5 | 48.5 | 3 | 5 |
| 2 | 90.5 | 96.5 | 6 | 8.5 |
| 3 | 135.5 | 136.5 | 1 | 3 |
| 4 | 180.5 | 184.5 | 4 | 6 |
| 5 | 225.5 | 232.5 | 7 | 1 |
| 6 | 270.5 | 272.5 | 2 | 4 |
| 7 | 315.5 | 320.5 | 5 | 7 |
| 8 | 360 | 360 | 8.5 | 2 |

IMAGE FORMING APPARATUS

CROSS REFERENCE TO RELATED APPLICATION

This application is based upon and claims the benefit of priority of Japanese Patent Application No. 2012-136839 filed on Jun. 18, 2012, the contents of which are incorporated herein by reference in its entirety.

BACKGROUND

The present disclosure relates to an image forming apparatus, and particularly, to a technology of controlling a phase of a rotator such as a photosensitive element in an image forming apparatus.

There has been a known technology of controlling a phase of a rotator such as a photosensitive element. A related art discloses a technology which uses photo sensors for detecting the reference positions of photosensitive drums (rotators) and a hall element for detecting rotation speed of a motor to detect the reference positions of the individual photosensitive drums, and perform phase control on the plurality of drums.

SUMMARY

However, in the related art, it is required to provide the photo sensors for detecting the reference positions of the photosensitive drums to the individual photosensitive drums, and thus there is a problem that a larger amount of cost is needed.

An object of an aspect of the present disclosure is to provide an image forming apparatus capable of reducing dedicated sensors for detecting the reference positions of rotators.

The aspect of the present disclosure provides the following arrangements:

An image forming apparatus comprising:

a plurality of rotators;

a drive motor configured to drive the plurality of rotators and including a hall element configured to output a hall signal according to a change of a magnetic field;

a counter configured to count the hall signal;

an image forming unit configured to form an image on a recording medium by transferring a plurality of color images from the plurality of rotators to the recording medium; and a controller configured to function as:

an acquiring unit configured to control the image forming unit to form a test pattern on the recording medium, and acquire correction information for correcting a positional deviation of the plurality of color images, based on information of the formed test pattern;

a phase managing unit configured to set phases of the plurality of rotators at a formation start timing of the test pattern, as reference phases, and manage the phases of the plurality of rotators based on a count value of the counter from the formation start timing; and a correcting unit configured to correct the positional deviation based on the phases which are managed by the phase managing unit, and the correction information acquired by the acquiring unit.

An image forming apparatus comprising:

an image forming unit configured to form an image on a sheet by transferring the first color image and the second color image on the sheet, the image forming unit including:

a first drum configured to carry a toner image;

a second drum configured to carry a toner image;

a first developer configured to generate a first color toner image on the first drum; and a second developer configured to generate a second color toner image on the second drum;

a motor including a shaft outputting a torque and a signal generator configured to output a signal every predetermined rotational angle of the shaft; and a transmitting device configured to transmit the torque from the motor to the first and second drums; and a controller configured to include a counter configured to increment a value held in the counter when receiving the signal from the signal generator, wherein when the value held in the counter reaches a predetermined value, the value stored in the memory is reset to an initial value.

DESCRIPTION OF EXEMPLARY EMBODIMENTS

Exemplary Embodiment

An exemplary embodiment will be described with reference to FIGS. 1 to 11.

1. General Configuration of Printer

Figure 1:
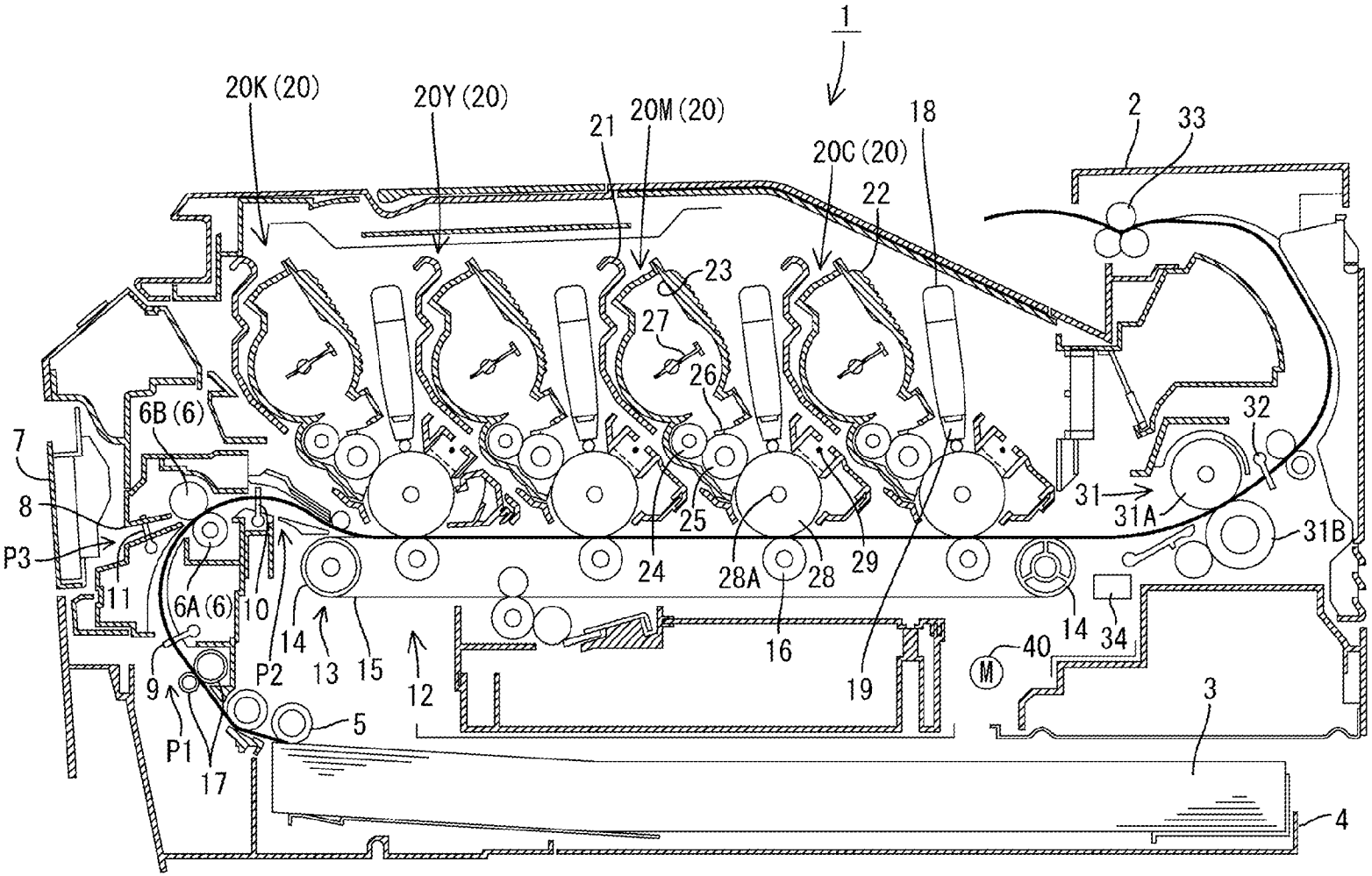
FIG. 1 is a sectional side view illustrating a schematic configuration of a printer according to an exemplary embodiment.

As shown in FIG. 1, a printer 1 which is an example of an image forming apparatus is a direct tandem type color LED printer which forms color images using toner of four colors (black K, yellow Y, magenta M, and cyan C). In the following description, referring to FIG. 1, a left-side direction and a right-side direction of the drawing sheet are referred to as a "front side" and a "rear side" of the printer, respectively. In FIG. 1, the reference symbols of identical components among the individual colors are appropriately omitted. Further, the image forming apparatus is not limited to the direct tandem type color LED printer, but may be, for example, a color laser printer or a multi-function device having a copy function and so on.

The printer 1 includes a main body casing 2, and a paper feed tray 4 which is provided at the lower portion in the main body casing 2 and allows a plurality of paper sheets (examples of recording media) 3 to be loaded. Above the front end of the paper feed tray 4, paper feeding rollers 5 are provided. According to rotation of paper feeding rollers 5, the uppermost paper sheet 3 loaded in the paper feed tray 4 is sent to a feeding path P1 provided at the front portion in the main body casing 2.

On the feeding path P1, auxiliary paper feeding rollers 17 and registration rollers 6 including a drive roller 6A and a driven roller 6B are provided. The drive roller 6A of the registration rollers 6 is connected to a main motor 40, for example, through a gear mechanism (not shown), and the driving force of the main motor 40 is transmitted to the drive roller 6A.

At the front surface in the main body casing 2, a manual guide 7 is provided to be tiltable toward the front side, and on the inside of the manual guide 7, a manual opening 8 is formed to allow the user to insert a paper sheet 3. The manual opening 8 is connected to the registration rollers 6 through a manual path P3, and from the registration rollers 6 toward the rear side, a conveyance path P2 is formed to be connected to a belt unit 13 of an image forming unit 12.

The registration rollers 6 can convey a paper sheet 3 fed from the feeding path P1 or a paper sheet 3 fed from the manual path P3 onto the belt unit 13 of the image forming unit 12 through the conveyance path P2. On the feeding path P1, the conveyance path P2, and the manual path P3, a pre-registration sensor 9, a post-registration sensor 10, and a manual sensor 11 are provided, respectively. The individual sensors 9, 10, and 11 sense existence or non-existence of a paper sheet 3 at their positions. At this time, the individual sensors 9, 10, and 11 detect passage of the front end portion and rear end portion of a paper sheet 3. Specifically, for example, each of the sensors 9, 10 and 11 generates (turns on) a predetermined detection signal if detecting passage of the front end portion of a paper sheet 3, and turns off the detection signal if detecting passage of the rear end portion of the paper sheet 3.

The image forming unit 12 includes the belt unit 13, exposing units 18, process units 20, a fixing unit 31, and so on.

The belt unit 13 includes an annular belt 15 which is suspended between a pair of front and rear belt supporting rollers 14. The rear belt supporting roller 14 is driven to rotate, whereby the belt 15 circularly moves in a clockwise rotation direction in FIG. 1 such that a paper sheet 3 carried on the upper surface of the belt 15 is carried toward the rear side. On the inside of the belt 15, four transfer rollers 16 are provided.

Above the belt unit 13, four exposing units 18 and process units 20 are provided. The individual exposing units 18 include LED units corresponding to the individual colors of black, yellow, magenta, and cyan, respectively, and have LED heads 19 at their lower end portions, respectively. Light emission of the exposing units 18 is controlled based on data on an image to be formed such that light is irradiated from the LED heads 19 onto the surfaces of photosensitive drums 28.

On the rear end side of the belt unit 13, an optical sensor 34 is provided for detecting the position of a patch (a test pattern) formed on the surface of the belt 15 during performance of known automatic positional deviation correction. In automatic positional deviation correction, a patch is formed on the belt 15, and is read by the optical sensor 34, and a positional deviation of an image to be formed is corrected. For example, the optical sensor 34 includes a light emitting element for irradiating light toward the patch, a light receiving element for receiving reflected light from the patch and the belt 15, an amplifier circuit for amplifying a signal of the light receiving element, and so on.

The process units 20 include four process cartridges 20K, 20Y, 20M, and 20C corresponding to the above-mentioned four colors. Each of the process cartridges 20K to 20C includes a cartridge frame 21, and a development cartridge 22 which is detachably mounted with respect to the cartridge frame 21. Each development cartridge 22 includes a toner container 23 for containing toner of a corresponding color as developer, and a feed roller 24, a development roller 25, a layer-thickness regulating blade 26, and the like provided below the toner container 23.

The toner discharged from the toner container 23 is supplied to the development roller 25 by rotation of the feed roller 24, and is triboelectrically and positively charged between the feed roller 24 and the development roller 25. Further, the toner supplied on the development roller 25 enters a gap between the layer-thickness regulating blade 26 and the development roller 25 by rotation of the development roller 25, and is triboelectrically charged more sufficiently in the gap, and is carried as a thin layer having a uniform thickness on the development roller 25.

Below the cartridge frames 21, the photosensitive drums (examples of rotators) 28 having surfaces covered with positively charged photosensitive layers, and chargers 29 are provided. The photosensitive drums 28 form nip portions through the belt 15 between the photosensitive drums 28 and corresponding transfer rollers 16. During image formation, the surfaces of the photosensitive drums 28 are uniformly and positively charged by the chargers 29. Then, the positively charged portions are exposed by the exposing units 18, such that electrostatic latent images are formed on the surfaces of the photosensitive drums 28.

Figure 2:
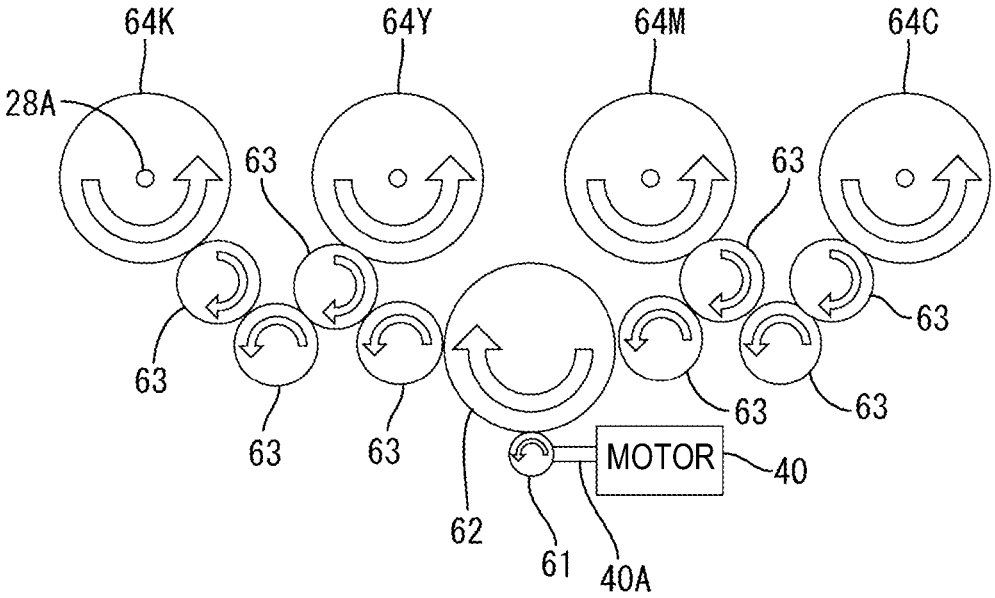
FIG. 2 is a view illustrating a rotation transmission form from a main motor to photosensitive drums.

As shown in FIG. 2, the rotary shafts 28A of the individual photosensitive drums 28K to 28C are connected to drum gears 64K to 64C at axial side portions of the photosensitive drums 28K to 28C, respectively. Further, as shown in FIG. 2, the individual drum gears 64K to 64C are linked to a reference gear 62 through intermediate gears 63, and the reference gear 62 is linked to a motor gear 61 connected to a rotary shaft 40A of the main motor 40.

Here, the number of teeth of the reference gear 62 is the same as the number of teeth of each of the drum gears 64K to 64C, and the number of teeth of each intermediate gear 63 is half the number of teeth of the reference gear 62. The number of teeth of the reference gear 62 is, for example, 24 times the number of teeth of the motor gear 61. Therefore, in a case where the main motor 40 rotates 24 revolutions, the reference gear 62 and each of the drum gears 64K to 64C rotate one revolution, and each intermediate gear 63 rotate two revolutions. In other words, in the present embodiment, in a case where the main motor 40 rotates 24 revolutions, the photosensitive drums 28K to 28C rotate one revolution at the same time.

Next, the positively charged toner carried on the developing rollers 25 is fed to the electrostatic latent images on the surfaces of the photosensitive drums 28, whereby the electrostatic latent images of the photosensitive drums 28 are visualized. Thereafter, while the paper sheet 3 passes nip positions between the photosensitive drums 28 and the transfer rollers 16, the toner images carried on the photosensitive drums 28 are sequentially transferred onto the paper sheet 3 by a negative transfer voltage which is applied to the transfer rollers 16.

Next, the paper sheet 3 having the toner image transferred thereon is conveyed to the fixing unit 31 by the belt unit 13. The fixing unit 31 conveys while pressing the paper sheet 3 conveyed from the transfer rollers 16, thereby fixing the developer image transferred on the paper sheet 3. The fixing unit 31 includes a heating roller 31A having a heat source, and a pressing roller 31B for pressing the paper sheet 3 toward the heating roller 31A. While the paper sheet 3 passes through the fixing unit 31, the image formation surface side of the paper sheet 3 is pressed by the heating roller 31A such that the transferred toner image is thermally fixed on the paper surface. The paper sheet 3 thermally fixed by the fixing unit 31 is conveyed upward, and is ejected to the upper surface of the main body casing 2 by discharging rollers 33. Further, on the downstream side relative to the fixing unit in a paper conveyance direction, an ejection sensor 32 is provided for detecting existence or non-existence of a paper sheet 3.

2. Electrical Configuration

Now, the electrical configuration of the printer 1 will be described with reference to FIGS. 3 and 4.

Figure 3:
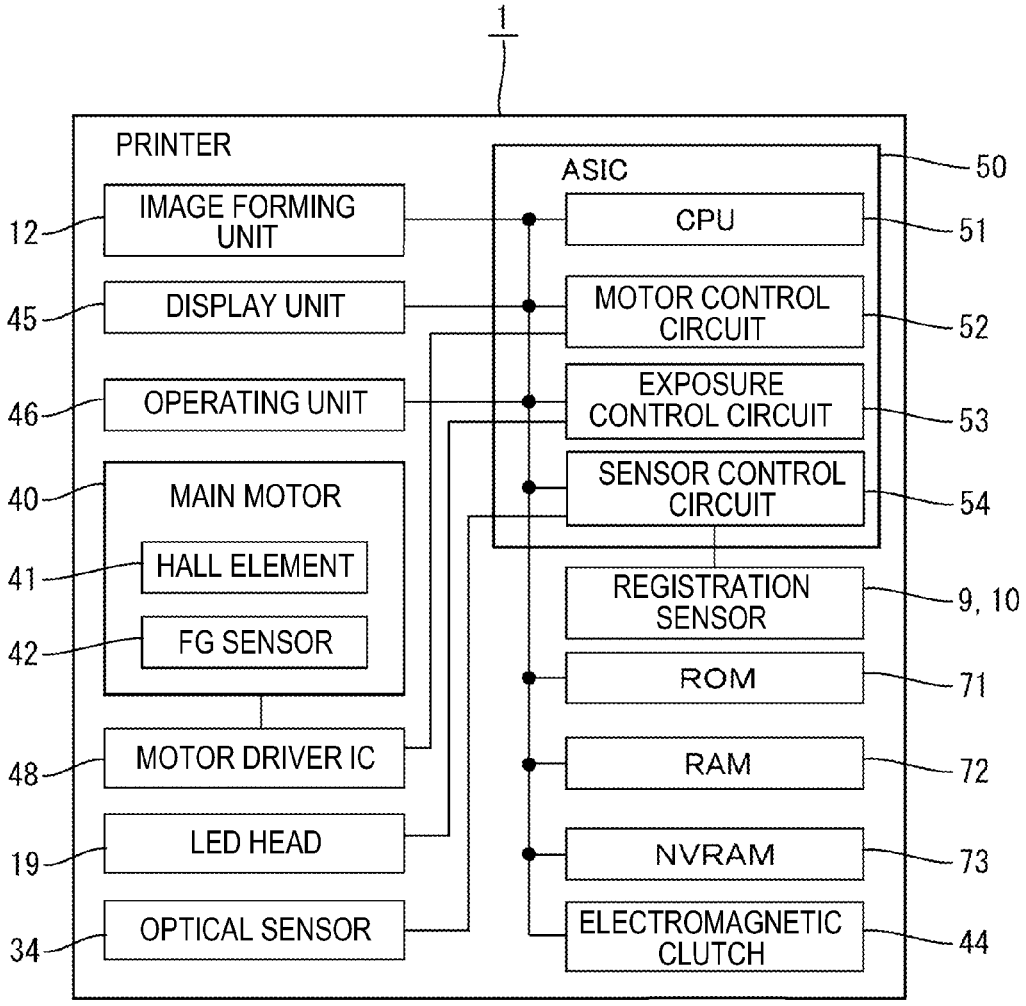
FIG. 3 is a block diagram schematically illustrating an electrical configuration of the printer.

As shown in FIG. 3, the printer 1 includes a CPU 51, a motor control circuit 52, an exposure control circuit 53, and a sensor control circuit 54. In the present embodiment, those circuits are configured by an application specific integrated circuit (ASIC) 50.

The ASIC 50 is connected to a ROM 71, a RAM 72, a non-volatile memory (NVRAM) 73, the image forming unit 12, a display unit 45, an operating unit 46, a motor driver IC 48, the LED heads 19, and so on.

The display unit 45 includes a liquid crystal display, lamps, and so on, and displays various option screens, the operation state of the printer, various warnings, and so on. The operating unit 46 includes a plurality of buttons, and enables a user to perform various kinds of input operation. For example, in a manual positional deviation correction print process to be described below, when the CPU 51 receives a user input according to information of a paper sheet 3 having a test pattern formed thereon, thereby acquiring correction information of positional deviation correction, a correction instruction value is input through the operating unit 46 by the user.

The ROM 71 stores various programs for performing the operation of the printer 1 such as the manual positional deviation correction print process to be described below, and the CPU 51 performs control on each unit according to programs read from the ROM 71 while storing the process results in the RAM 72 or the NVRAM 73.

The motor driver IC 48 is connected to the main motor 40. Here, the main motor 40 is, for example, a three-phase brushless DC motor in view of high torque and low vibratility, and includes hall elements 41 and a frequency generator (FG sensor) 42. The hall elements 41 are provided to correspond to individual phases (a U phase, a V phase, and a W phase). In order to detect the rotation position of the main motor 40, the hall elements 41 generate hall signals HS according to a change of a magnetic field, and outputs the hall signals HS to the motor driver IC 48. In order to detect the rotation speed of the main motor 40, the FG sensor 42 generates a FG signal changing according to the rotation speed of the main motor 40, and outputs the FG signal to the motor driver IC 48.

Figure 4:
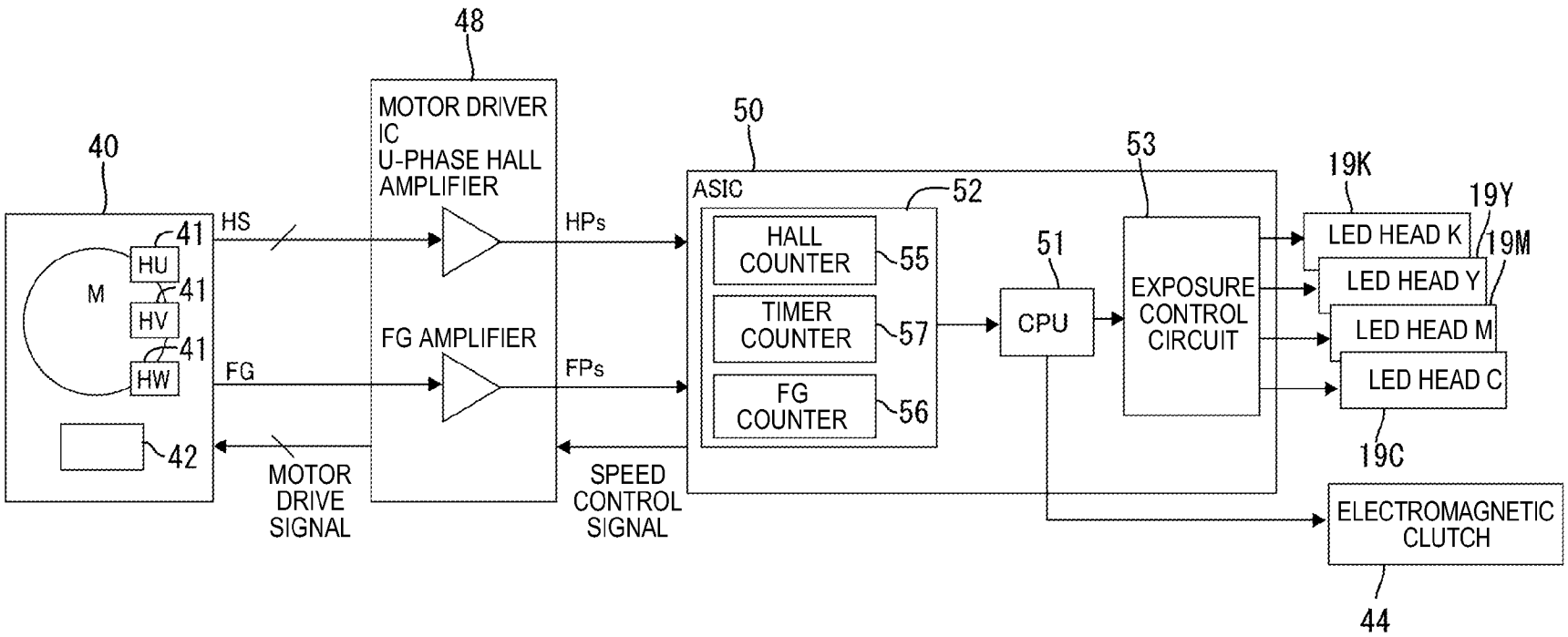
FIG. 4 is a block diagram schematically illustrating a circuit configuration for performing exposure control based on phase management of the photosensitive drums.

As shown in FIG. 4, the motor driver IC 48 includes hall amplifiers for the individual phases, and an FG amplifier. In FIG. 4, only U-phase hall amplifier is shown. Each hall amplifier converts switching of the phase of a corresponding hall signal HS which is an analog signal, into a digital pulse signal. Here, the main motor 40 is a 16-pole motor, and generates a hall pulse signal HPs, which is composed of 8 pulses (hereinafter, referred to as 'hall pulses') for one revolution, from the hall signal HS from the U-phase hall element 41, and outputs the hall pulse signal HPs to the ASIC 50 (see FIG. 5).

The FG amplifier amplifies the FG signal and converts the FG signal into a digital pulse signal. In other words, the FG amplifier generates an FG pulse signal FPs, which is composed of a predetermined number of pulses (hereinafter, referred to as 'FG pulses') according to the rotation speed of the main motor 40, from the FG signal which is an analog signal, and outputs the FG pulse signal FPs to the ASIC 50.

The motor control circuit 52 includes a hall counter (an example of a count unit) 55, a FG counter 56, and a timer counter 57. The hall counter 55 receives the hall pulse signal HPs, and counts the number of hall pulses HP included in the hall pulse signal HPs (a hall pulse count value HPC). Further, the FG counter 56 receives the FG pulse signal FPs, and counts the number of FG pulses included in the FG pulse signal FPs. Furthermore, the timer counter 57 is used for measuring various times such as the pulse periods of the hall pulses HP.

The sensor control circuit 54 is connected to the pre-registration sensor 9 and the post-registration sensor 10, and acquires the position information of the paper sheet 3. The sensor control circuit 54 is connected to the optical sensor 34, and acquires the position information of the patch from the optical sensor 34 during performance of automatic positional deviation correction.

The CPU 51 computes a motor phase pattern based on a signal from the motor control circuit 52 and calculates a drum period or the like based on the motor phase pattern, for example, when correcting a positional deviation of an image to be formed, based on a test pattern. The CPU 51 generates a correction signal for correcting an exposing time or the like based on the drum period (phase), and supplies the correction signal to the exposure control circuit 53. The exposure control circuit 53 controls exposure timings of the LED heads 19 based on the correction signal.

In this electrical configuration, the CPU 51 (an example of an acquiring unit, a phase managing unit, and a correcting unit) controls the image forming unit 12 such that a test pattern is formed on a paper sheet 3 through the photosensitive drums 28, and acquires correction information for correcting a positional deviation of a plurality of color images based on information on the formed test pattern. Next, the CPU 51 sets the phases of the photosensitive drums 28 at the formation start timing of the test pattern as reference phases P(0), and manages the phases of the photosensitive drums 28 based on the count value of the hall counter 55 from the formation start timing. Then, the CPU 51 corrects the positional deviation based on the managed phases of the photosensitive drums 28 and the acquired positional deviation correction information.

3. Phase Management of Photosensitive Drums

Figure 6:
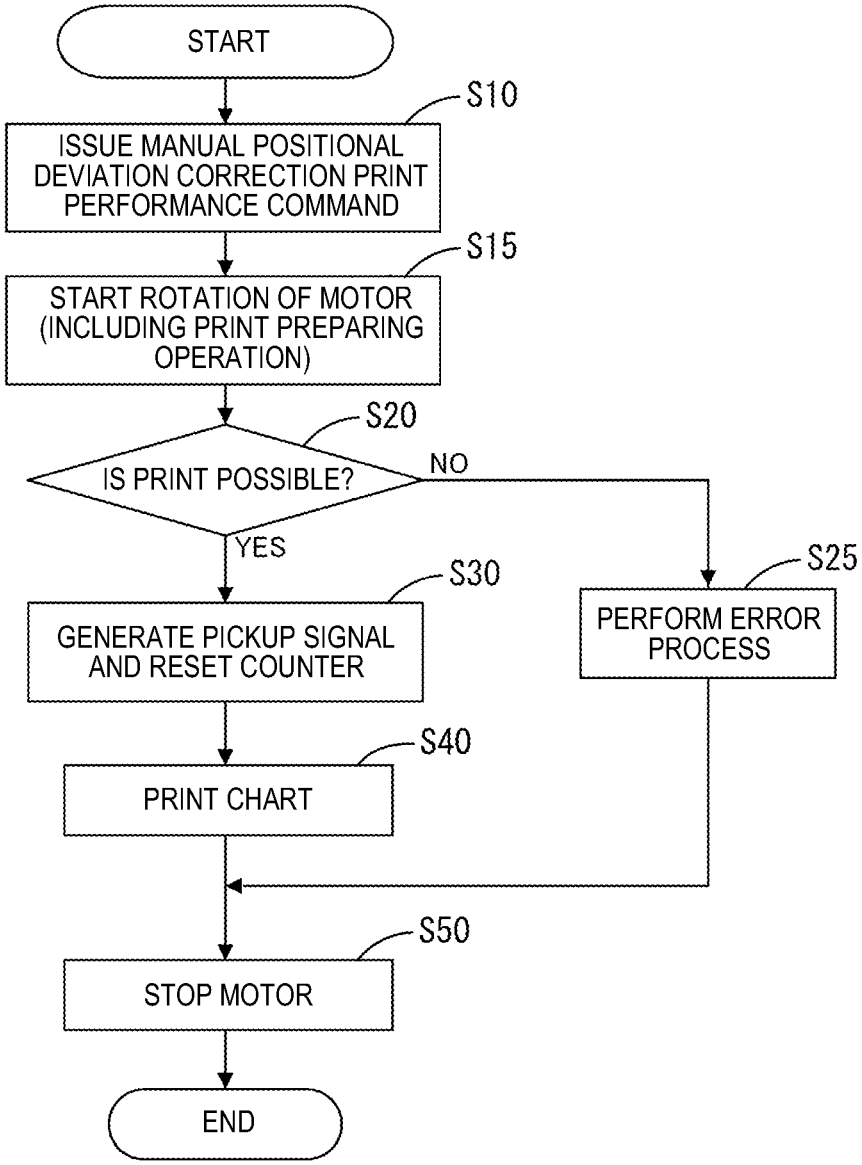
FIG. 6 is a flow chart illustrating a process related to chart print for manual positional deviation correction.
Figure 7:
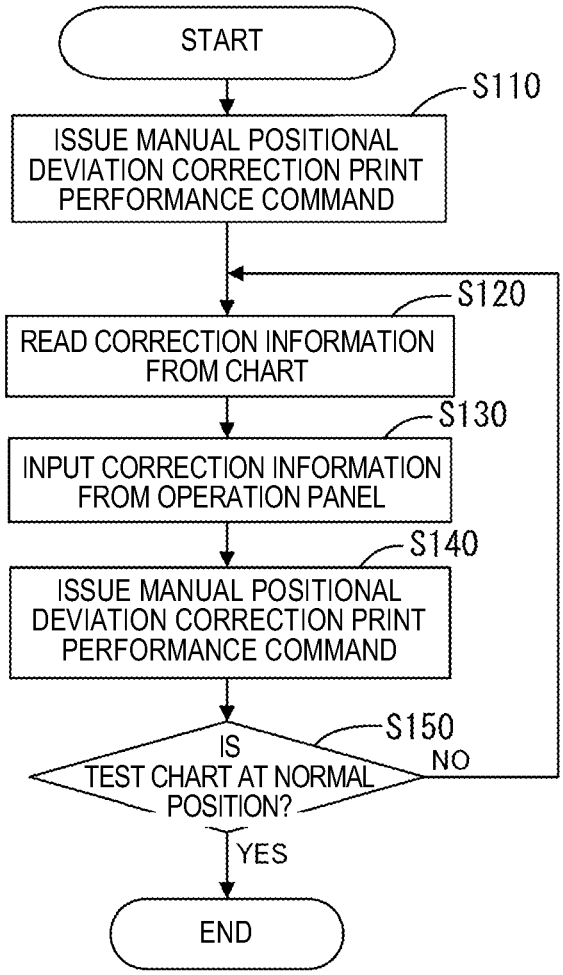
FIG. 7 is a flow chart illustrating a process by a user in manual positional deviation correction.

Now, phase management of the photosensitive drums 28 in the present embodiment will be described with reference to FIGS. 5 to 8. FIG. 6 is a flow chart illustrating a print process of a chart for manual positional deviation correction in a manual positional deviation correction process, and each process is performed according to a predetermined program by the CPU 51. FIG. 7 is a flow chart illustrating a process which is performed by the user, in the manual positional deviation correction process.

The phase management of the photosensitive drums 28 is performed when the positional deviation of the image to be formed is corrected based on the test pattern. In the present embodiment, as the positional deviation correction, a case of so-called 'manual positional deviation correction' in which a positional deviation correction chart (an example of the test pattern) is printed on a paper sheet 3, and the user reads correction information from the correction chart and inputs the value of the correction information from the operating unit 46 will be described.

The positional deviation correction includes so-called dynamic positional deviation correction of correcting periodic positional deviations attributable to deformation of the photosensitive drums 28 or the like, and so-called static positional deviation correction of correcting predetermined positional deviations attributable to deviations of exposure timings among the individual colors or the like, and uses a correction chart corresponding to each positional deviation correction. Hereinafter, the case of the dynamic positional deviation correction will be described.

For example, in a case where deformation, for example, eccentricity occurs as a dynamic positional deviation in a photosensitive drum 28 of one color, the pitch of lines in a main scan direction during transferring onto the paper sheet 3 does not correspond to those of the photosensitive drums 28 of the other three colors, whereby positional deviations occurs in color images. As a result, periodic color deviations according to rotation of the photosensitive drums 28 occur.

In the dynamic positional deviation correction, a chart for manual positional deviation correction for correcting dynamic positional deviations is printed, and information necessary for correcting the dynamic positional deviations is read from that chart and is input, whereby it is possible to reduce the dynamic positional deviations. At this time, since the dynamic positional deviations relate to the rotating speeds of the photosensitive drums 28, that is, the phases of the photosensitive drums 28, the phase management of the photosensitive drums is required. In the case of the dynamic positional deviation correction, since the same phase management is performed on the photosensitive drums 28 of the individual colors, the following description will be made without particularly distinguishing the photosensitive drums 28 of the individual colors.

First, timings related to the phases of the photosensitive drums 28 will be described with reference to the time chart of FIG. 5.

Figure 5:
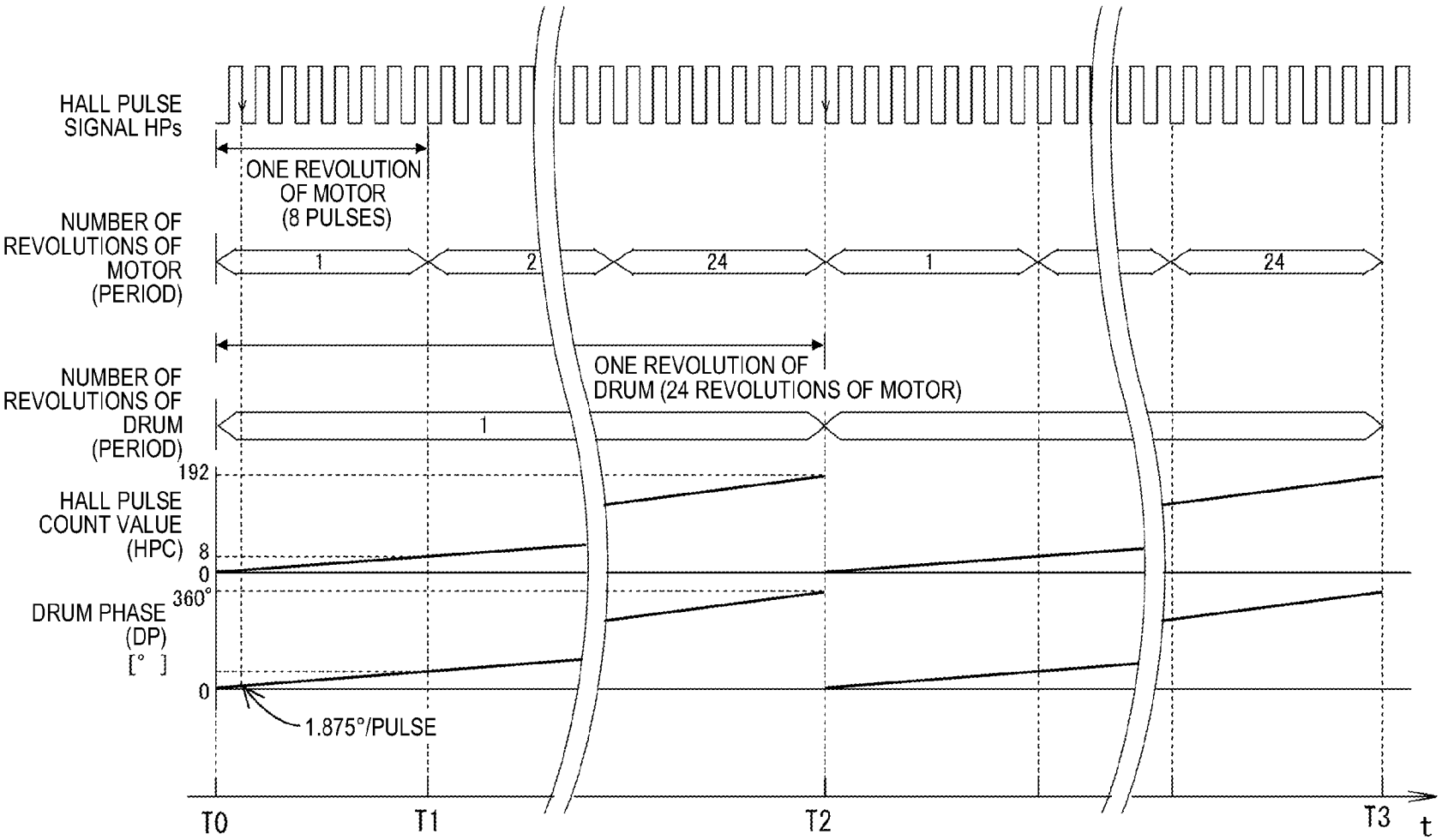
FIG. 5 is a time chart illustrating a synchronized form of individual signals.

As described above, the period of one revolution of the main motor 40 corresponds to a period corresponding to 8 hall pulses HP (see a time T1 of FIG. 5). While the main motor 40 rotates 24 revolutions, the photosensitive drums 28 rotate one revolution. This is because the number of teeth of the reference gear 62, that is, the number of teeth of each drum gear 64 is 24 times the number of teeth of the motor gear 61 as described above. Specifically, the reason is that the number of teeth of each intermediate gear 63 is 12 times the number of teeth of the motor gear 61, and if the main motor 40 rotates an integer number of revolutions, (here, 24 revolutions), the photosensitive drums 28 rotate one revolution by the intermediate gears 63.

Therefore, the period of one revolution of each photosensitive drum 28 corresponds to the period corresponding to 192 (8×24) hall pulses HP (see times T2 and T3 of FIG. 5). The hall counter 55 is reset whenever the photosensitive drums 28 rotate one revolution. In other words, if the hall pulse count value HPC reaches 192, the hall counter 55 is reset to 0.

If the phases (rotation angles) of the photosensitive drums 28 are computed, one period of the hall pulses HP corresponds to 1.875° (360/192) of the phases (hereinafter, referred to as drum phases) DP of the photosensitive drums 28. Therefore, in the present embodiment, the CPU 51 recognizes the drum phases DP from the hall pulse count value HPC, and manages the drum phases DP.

Figure 8:
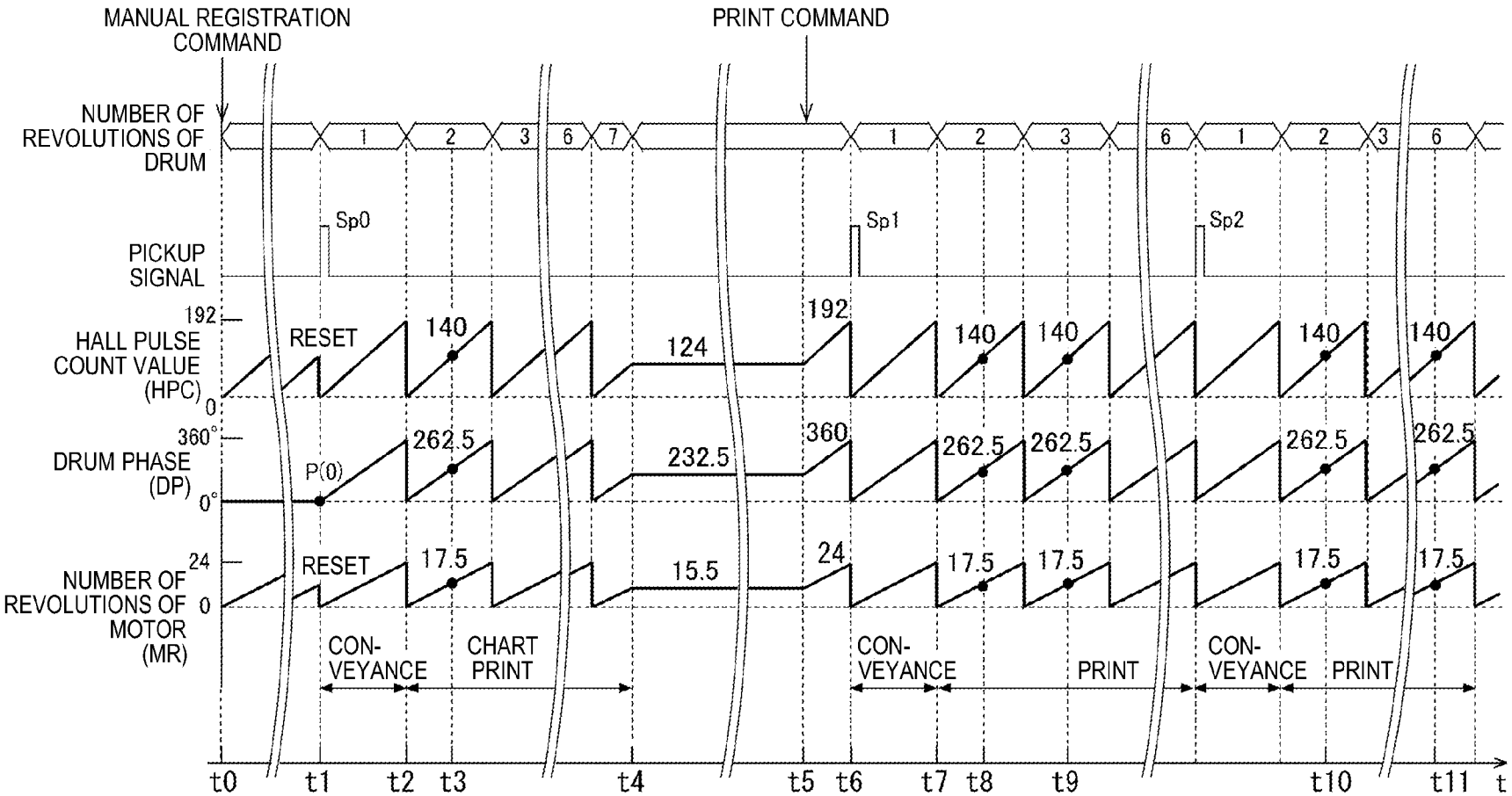
FIG. 8 is a time chart related to phase management of the photosensitive drums.

Meanwhile, if a manual positional deviation correction print performance command is issued at a time t0 of FIG. 8 through the operating unit 46 by the user in STEP S110 of FIG. 7, the CPU 51 receives the manual positional deviation correction print performance command from the operating unit 46 in STEP S10 of FIG. 6, starts rotation of the main motor 40 according to the manual positional deviation correction print performance command, and starts a print preparing operation, such as heating the heating roller 31A of the fixing unit 31, in STEP S15. At the time t0 of FIG. 8, at the same time of the start of the rotation of the main motor 40, the CPU 51 makes the hall counter 55 start to count the hall pulse count value HPC, and starts to compute the number of revolutions of the main motor 40 (motor revolution number MR) based on the hall pulse count value HPC.

Next, after a predetermined time elapses, the CPU 51 determines whether print is possible in STEP S20. In a case of determining that print is possible (YES in STEP S20), the CPU 51 generates a pickup signal Sp0 for pricking up a paper sheet 3 for manual positional deviation correction print. At the same time, the pickup signal Sp0 is supplied to an electromagnetic clutch 44 for transmitting driving to the paper feeding rollers 5 for a predetermined time, so as to start that pickup of a paper sheet 3 starts and reset the hall pulse count value HPC in STEP S30. Therefore, the drum phases DP are reset to the reference phases P(0) (STEP S30). Here, the reference phases P(0) are the phases of the photosensitive drums 28 at a time t1 when the pickup of the paper sheet 3 for manual positional deviation correction print started, and are 0° here.

As described above, in the present embodiment, the reference phases P(0) of the photosensitive drums 28 are considered to be the phases of the photosensitive drums 28 during generation of the pickup signal Sp0 according to the first manual positional deviation correction print performance command, in other words, the phases of the photosensitive drums 28 at the timing of pickup of the paper sheet 3. In other words, in the present embodiment, time t1 of FIG. 8 which is a timing of pickup of the paper sheet 3 for manual positional deviation correction print according to the first manual positional deviation correction print performance command corresponds to the formation start timing of the test pattern.

Meanwhile, in a case of determining that print is impossible (NO in STEP S20), the CPU 51 performs an error process in STEP S25, and terminates the manual positional deviation correction print.

Next, in STEP S40, the CPU 51 controls the image forming unit 12, for example, at a time t2 when the photosensitive drums 28 have rotated one revolution, such that an operation for printing a predetermined test pattern (test chart) for correcting dynamic positional deviations on a paper sheet 3 starts. At a time t4, if the operation of printing the test chart terminates, the paper sheet 3 is ejected. In FIG. 8, an example in which the printing operation on the paper sheet 3 is performed until the midway of the seventh revolution of the photosensitive drums 28 is shown.

The test pattern includes, for example, a plurality of parallel straight lines having been exposed and developed at predetermined intervals and extending in the main scan direction (a direction perpendicular to the paper conveyance direction). If eccentricity or the like occurs in the photosensitive drums 28, the intervals (pitches) of the parallel straight lines having been transferred on the paper sheet 3 change periodically. The magnitude (amplitude) of the amount of change, and a position which becomes the center of the change are read from the test chart, and are used as information for positional deviation correction.

The CPU 51 stops the rotation of the motor 40 at the time t4 when the operation of printing the test chart terminates, and makes the hall pulse count value HPC (for example, '124') at that time be held in the timer counter 57. Therefore, the process of printing the chart for manual positional deviation correction terminates.

The CPU 51 may store each of the hall pulse count value HPC, the drum phases DP (for example, '232.5'), and the motor revolution number (for example, '15.5') in the NVRAM 73. In this case, the numeral values to be stored in the NVRAM 73 are not limited thereto. For example, only the hall pulse count value HPC may be stored in the NVRAM 73. The reason is that the other numeral values can be computed from the hall pulse count value HPC based on the above-mentioned relation shown in FIG. 5.

If the chart (test chart) for manual positional deviation correction is printed, as shown in FIG. 7, the user reads the positional deviation correction information from the printed test chart in STEP S120, and inputs the correction information from the operating unit 46 in STEP S130.

The positional deviation correction is performed generally by adjusting the exposure timings of the photosensitive drums 28. Therefore, in order to accurately adjust the exposure timings for the positional deviation correction, it is required to specify the phases of the photosensitive drums 28 from the reference positions, that is, the rotation angles from the reference positions. In the present embodiment, as the reference positions of the photosensitive drums 28, the reference phases P(0) are used. Then, the phases of the photosensitive drums 28 are managed based on the hall pulse count value HPC from the reference phases P(0). Therefore, the exposure timings for the positional deviation correction are specified.

For example, in positional deviation correction by the user, exposure timings of a pattern image for acquiring the correction information are set as the phases of the photosensitive drums 28, and at a time t3 of FIG. 8, the hall pulse count value HPC is shown as '140'. In this case, the reference phases P(0) is set to '0°', and the phases of the photosensitive drums 28 are specified to '262.5°'. Therefore, if predetermined exposure-timing correction is performed based on the information in which the hall pulse count value HPC is '140', it is possible to correct positional deviations (dynamic positional deviations) attributable to rotation of the photosensitive drums 28, for example, positional deviations (color deviations) attributable to eccentricity of the photosensitive drums 28.

Next, after the correction information is input, in order to check whether correction has been precisely performed, the user issues a manual positional deviation correction print performance command again in STEP S140. Then, in order to print the test chart again, the CPU 51 repeats the processes of STEPS S10 to 50 of FIG. 6.

When the test chart is printed again, according to start of rotation of the motor 40, the timer counter 57 starts to count the hall pulse count value HPC from the held count value, for example, '124'. Then, when the print preparing finishes and the count value reaches '192', the CPU 51 generates a pickup signal Sp, and makes a paper sheet 3 for reprinting be picked up. Then, if reprinting of the test chart terminates, and the motor 40 stops in STEP S50, the hall pulse count value HPC at that time, for example, '124' is held in the timer counter 57, as when the test chart was first printed.

Next, in STEP S150 of FIG. 7, the user determines whether the print result of the reprinted test chart is normal, that is, whether the test chart has been printed at a normal position. In a case where the print result is normal (YES in STEP S150), the manual positional deviation correction process terminates. Meanwhile, in a case where the print result of the test chart is not normal (NO in STEP S150), the user further repeats the processes of STEPS S120 to S150.

Now, a case where a normal print command is issued will be described with reference to FIG. 8. Here, it is assumed that, in a case where a predetermined print job is performed, a print command is issued at a time t5 as shown in FIG. 8. At this time, for example, the main motor 40 starts to rotate. Accordingly, the timer counter 57 starts to count the hall pulse count value HPC from the count value held at the time t5, for example, '124'.

Then, after the print preparing finishes, at a time t6 when the count value reaches '192', the CPU 51 generates a pickup signal Spl for printing, makes a paper sheet 3 for printing be picked up, and makes conveyance of the paper sheet 3 start. In a case of requiring time for print preparing, for example, in a case where heating of the heating roller 31A of the fixing unit 31 or the like is required, a period corresponding to a plurality of revolutions of the photosensitive drums 28 may be further provided between the time t5 and the time t6.

Next, for example, at a time t7 after one revolution of each photosensitive drum 28, print starts. Then, for every revolution of the photosensitive drums 28, at a timing when the hall pulse count value HPC becomes '140' (from a time t8 to a time t11), the exposure timings related to the positional deviation correction are adjusted. Then, if printing related to the print command entirely terminates, like in STEP S50 of FIG. 6, the CPU 51 stops the main motor 40, and makes at least the hall pulse count value HPC at that time, be held in the timer counter 57 or stores the hall pulse count value HPC in the NVRAM 73.

Next, if a manual positional deviation correction print performance command or a normal print command is issued, the CPU 51 starts rotation of the motor 47, and makes the hall pulse count value HPC start to be counted from the held or stored count value. Then, when the hall pulse count value HPC reaches '192', the CPU 51 makes the pickup signal Sp for printing be generated.

As described above, in a case where the hall pulse count value HPC is not '192' when the image forming unit 12 starts image formation, the CPU 51 rotates the main motor 40 until the count value HPC becomes '192', and at a timing when the count value HPC becomes '192', the CPU 51 makes image formation of the image forming unit 12 start. Therefore, it is possible to start image formation from the same positions of the photosensitive drums 28 based on the hall pulse count value HPC, without using dedicated sensors for detecting the reference positions of the photosensitive drums 28. Accordingly, it is also possible to appropriately perform positional deviation correction, without using dedicated sensors.

As described above, in a case of using the phases of the photosensitive drums 28 at the timing of pickup of the paper sheet 3 according to the manual positional deviation correction print performance command as the reference phases P(0), the timing when the photosensitive drums 28 become the reference phases P(0) is a timing when the hall pulse count value HPC becomes an integer multiple of '192' after the photosensitive drums 28 rotate a plurality of revolutions since a paper sheet 3 has been first picked up in manual positional deviation correction print. Therefore, for example, in a case of first performing manual positional deviation correction print in the product, it is only needed to pick up a paper sheet 3 at an arbitrary timing, set the phases of the photosensitive drums 28 at that time (corresponding to the time t1 of FIG. 8) as the reference phases P(0), reset the hall pulse count value HPC, and count the subsequent hall pulses.

In FIG. 8, an example in which a conveyance period is a period where the photosensitive drums 28 rotate one revolution is shown. However, the present invention is not limited thereto.

In a case where the hall pulse count value HPC is not an integer multiple of the count value '192' corresponding to one revolution of each photosensitive drum 28, the photosensitive drums 28 may be rotated until the count value HPC becomes an integer multiple of '192', and at a timing when the count value HPC becomes an integer multiple of '192', image formation of the image forming unit 12 may start. In other words, the maximum value of the hall pulse count value HPC is not limited to the count value '192' corresponding to one revolution of each photosensitive drum 28, but may be an integer multiple of '192'.

4. Correction of Hall Pulse Count Value

Figure 9:
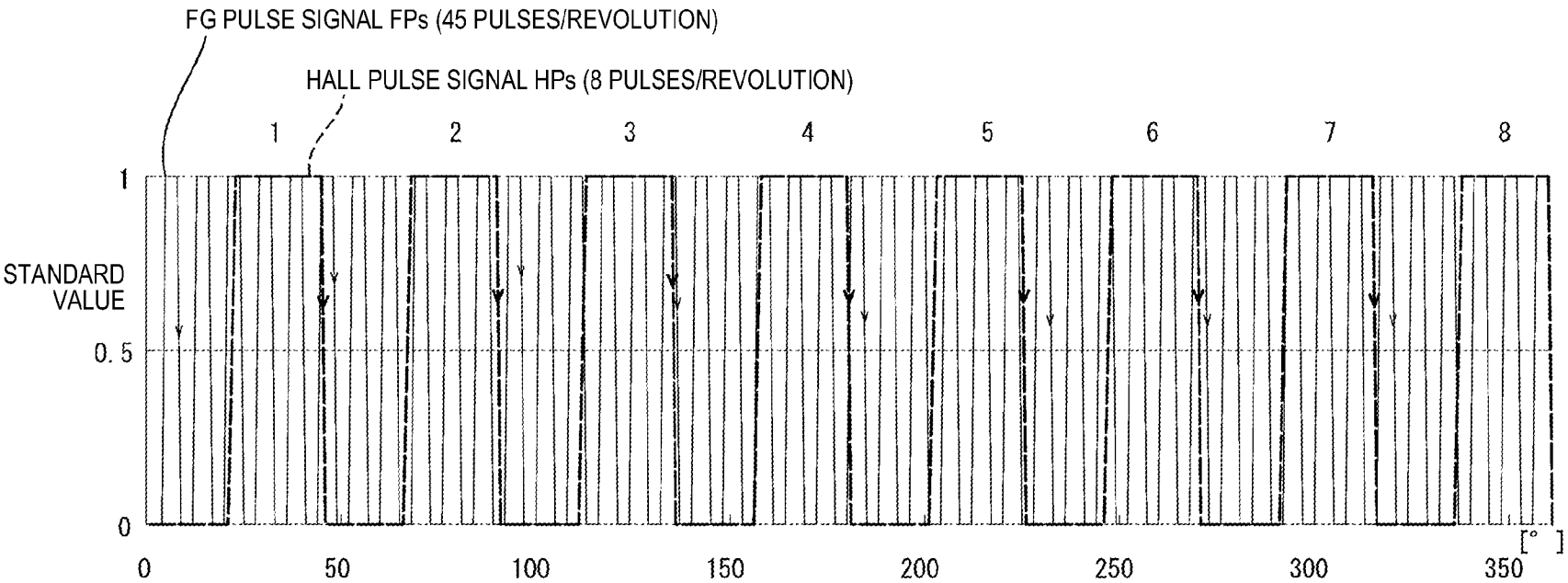
FIG. 9 is a time chart illustrating a phase relation between a hall pulse signal and an FG signal.

Now, correction of the hall pulse count value HPC will be described with reference to FIGS. 9 to 11. In FIG. 9, the vertical axis represents the maximum value of a signal standardized to '1'.

Correction of the hall pulse count value HPC is required, for example, in a case where the main motor 40 reversely rotates by a reaction force from the load side or the like during stopping of the main motor 40. Even in the case where the main motor 40 reversely rotates, according to the reverse rotation, the hall pulse count value HPC increases such that an error occurs between the actual phases of the photosensitive drums 28 and the hall pulse count value HPC. For this reason, in order to match the phases of the photosensitive drums 28 and the hall pulse count value HPC at that time, the hall pulse count value HPC is corrected. All of hall pulses of three phases (the U phase, the V phase, and the W phase) may be used to detect reverse rotation, and during reverse rotation, the hall pulse count may decrease.

As shown in FIG. 9, the number of pulses of the FG pulse signal FPs per one revolution of the main motor 40 is set to '45', and the number of pulses of the hall pulse signal HPs per one revolution of the main motor 40 is set to '8'. In other words, the frequency of the FG pulse signal FPs is defined to a frequency which is larger than the frequency of the hall pulse signal HPs, and does not have the frequency of the hall pulse signal HPs as a common divisor.

Figures 10, 11:
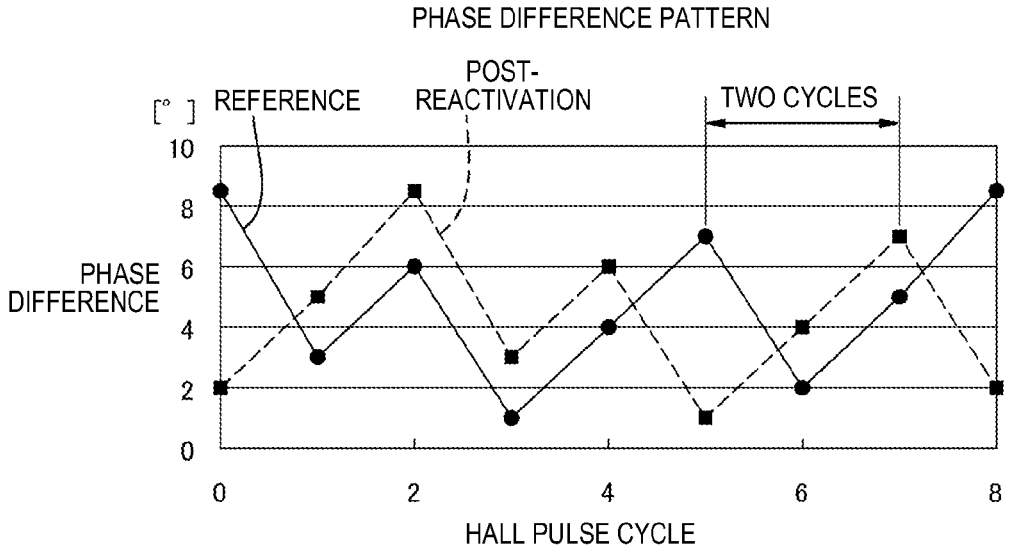
FIG. 10 is a table showing phase differences between the hall pulse signal and the FG signal.
FIG. 11 is a graph illustrating a phase difference pattern.

Then, during constant-speed rotation of the main motor 40, the CPU 51 acquires a reference phase difference pattern as shown in FIG. 11, from a phase difference (reference phase difference) between the hall pulse signal HPs and the FG pulse signal FPs in each pulse period of the hall pulse signal HPs in one period of rotation of the main motor 40 as shown in FIGS. 9 and 10. Here, each reference phase difference refers to a phase difference from a falling timing of the hall pulse signal HPs to the next falling timing of the FG pulse signal FPs in the cycle of each hall pulse signal HPs as shown FIG. 9. Each timing refers to a timing when the amplitude value of the hall pulse signal HPs becomes almost an intermediate value (0.5) as shown in FIG. 9.

Next, after the main motor 40 is reactivated during formation of the test pattern, similarly, the CPU 51 acquires a post-reactivation phase difference pattern as shown in FIG. 11, from a post-reactivation phase difference between the FG pulse signal FPs and the hall pulse signal HPs in each pulse period of the hall pulse signal HPs in one period of the rotation of the main motor 40 as shown in FIG. 10.

Then, the CPU 51 corrects the hall pulse count value HPC according to an amount of deviation of the post-reactivation phase difference pattern relative to the reference phase difference pattern. In the example shown in FIGS. 10 and 11, since the amount of deviation between two patterns is two cycles, the hall pulse count value HPC is corrected by 2.

As described above, it is possible to correct an error of the hall pulse count value HPC according to rotation of the motor which does not depend on normal motor rotation, from the amount of deviation between the reference phase difference pattern between the FG pulse signal FPs and the hall pulse signal HPs during the constant-speed rotation of the main motor 40, and the phase difference pattern after reactivation of the main motor 40. In other words, according to the amount of deviation, the hall pulse count value HPC is corrected, that is, decreased or increased, whereby it is possible to correct an error of the hall pulse count value HPC attributable to reverse rotation of the motor during stopping of the main motor.

When correcting the hall pulse count value HPC, it is possible to reduce the number of terminals for detecting circuits and signal lines (harnesses) as compared to a configuration in which the hall pulse signal HPs of each phase of the three phases is detected and the correction of the hall pulse count value HPC is performed.

5. Advantage of Present Embodiment

As described above, according to the present embodiment, when a positional deviation (color deviation) of an image to be formed is corrected based on a test pattern, it is possible to manage the phases of the photosensitive drums 28 based on the hall pulse count value HPC from the formation start timing of the test pattern (the time t1 of FIG. 8), that is, the number of pulses of the hall pulse signal HPs, without using dedicated sensors. Therefore, it is possible to reduce dedicated sensors for detecting the reference positions of the photosensitive drums 28.

In general, the number of pulses of the hall pulse signal HPs, that is, the number of hall pulses HP is an integer multiple of (8 times in the present embodiment) the number of revolutions of the main motor 40. Therefore, the intermediate gears 63 are provided for making the photosensitive drums 28 rotate one revolution according to an integer number of revolutions (24 revolutions) of the main motor 40, whereby it is possible to harmonize the number of the hall pulses HP (the hall pulse count value HPC) and one revolution of the photosensitive drums 28. In other words, the hall pulse count value HPC is managed, whereby it is possible to set the phases (0°) of the photosensitive drums 28 at the formation start timing of the test pattern (the time t1 of FIG. 8) as the reference phases P(0), and precisely manage the drum phases DP based on the hall pulse count value HPC from the formation start timing

Other Embodiments

The present invention is not limited to the embodiment described with reference to the drawings. For example, the following embodiments are also included in the technical scope of the present invention.

(1) In the above-mentioned embodiment, an example of correcting dynamic positional deviations in manual positional deviation correction has been shown. However, the present invention is not limited thereto. The present invention can be applied even when static positional deviations in the manual positional deviation correction are corrected.

In general, in a chart for manual positional deviation correction for correcting static positional deviations, a plurality of patterns is formed side by side by shifting the pitch of a reference color and an adjustment color little by little. Further, the user visually checks a position where the reference color and the adjustment color on the printed chart for manual positional deviation correction overlap, reads a value assigned to that position, as correction information, and inputs that value from the operating unit 46. In this way, an exposure-timing correcting process is performed.

However, when a chart for manual positional deviation correction is printed again for checking after the exposure-timing correcting process is performed, if a dynamic positional deviation occurs at a different timing with respect to a paper sheet, the position where the reference color and the adjustment color overlap deviates from an appropriate position on the chart for manual positional deviation correction.

In order to avoid this problem, even when static positional deviations are corrected, phase management of the photosensitive drums 28 is required. Therefore, for example, whenever the chart for correcting static positional deviations is printed, exposing starts with respect to the photosensitive drums 28 at the same phase. Accordingly, during static positional deviation correction, static positional deviations and dynamic positional deviations are distinguished, whereby it is possible to appropriately perform static positional deviation correction. In the static positional deviation correction, the exposure start timing of each photosensitive drum 28 is corrected according to the chart for static positional deviation correction. In this case, as a phase managing method, a managing method as shown in FIG. 8 can be applied.

(2) In the above-mentioned embodiment, an example of forming a manual positional deviation correction pattern by receiving an user input according to information of a paper sheet having a test pattern formed thereon when acquiring the correction information for correcting positional deviations of a plurality of color images (a case of performing manual positional deviation correction) has been shown. However, the present invention is not limited thereto. It is possible to apply the phase management of the photosensitive drums of the present application even to a case of so-called automatic positional deviation correction. In other words, in a predetermined period, a plurality of patches (test patterns) for positional deviation correction is formed on the belt 15, regardless of an instruction of the user, the patches for correction are detected by the optical sensor, and a correlation value (correction information) of positional deviations is determined based on the detection value. Further, it is possible to apply the phase management of the photosensitive drums of the present application even in a case of correcting exposure timings based on the determined correlation value.

(3) In the above-mentioned embodiment, as a method of correcting the hall pulse count value HPC, an example of correcting the hall pulse count value HPC based on the hall pulse signal HPs and the FG pulse signal FPs has been shown. However, the present invention is not limited thereto. For example, the printer may further include a storage unit which stores the pulse period of the hall signal, an updating unit which updates the pulse period stored in the storage unit for every pulse, and a determining unit configured to determine that the drive motor has rotated reversely, in a case where the pulse period updated by the updating unit is shorter than the pulse period stored in the storage unit when the drive motor (main motor) stops is to be stopped rotating, and decrease the hall pulse count value HPC, thereby correcting the hall pulse count value HPC. In this case, for example, the storage unit may be configured by the NVRAM 73, the updating unit may be configured by the timer counter 57 and the CPU 51, and the determining unit may be configured by the CPU 51.

In general, in a case where the drive motor stops, according to a reduction in the rotation speed, the pulse period of the hall signal lengthens. Therefore, it is possible to sense reverse rotation of the drive motor from a change of the pulse period during stopping of the drive motor, and to reflect a change of the phases of the rotators attributable to the reverse rotation to the count value. In other words, it is possible to prevent occurrence of a difference between the phases of the rotators and the count value according to the reverse rotation during stopping of the drive motor.

(4) In the above-mentioned embodiment, in a case of forming a manual positional deviation correction pattern, the phases of the photosensitive drums 28 at the pickup timing of the paper sheet 3 (the time t1 of FIG. 8) according to a first manual positional deviation correction print performance command are set as the reference phases P(0). However, the present invention is not limited thereto. In other words, the formation start timing of the test pattern when determining the reference phases of the phases of the rotator is set to the pickup timing of the paper sheet 3. However, the present invention is not limited thereto.

For example, in a case of so-called automatic positional deviation correction in which a patch (test pattern) is formed on the belt 15, the patch is read by the optical sensor 34, and a positional deviation of an image to be formed is corrected, the reference phases P(0) may be the phases of the photosensitive drums 28 at a start timing of exposing of first patch data. In other words, in the case of the automatic positional deviation correction, the formation start timing of the test pattern may be the start timing of the exposing of the first patch data according to an automatic positional deviation correction command.

In other words, in the manual positional deviation correction, since the test pattern is formed on the paper sheet 3, it is required to set the reference phases P(0) in associated with the position of the paper sheet 3 such as the timing to generate a paper sheet pickup signal. In contrast, in automatic positional deviation correction, since the test pattern is formed on the belt, as known, it is possible to associate the amount of deviation of the test pattern on the belt 15, that is, an exposure-timing correction value with relative phases (hall pulse count value) from the reference phases P(0). Therefore, in the automatic positional deviation correction, during printing onto the paper sheet 3, it is possible to correct the exposure timings based on the hall pulse count value corresponding to arbitrary phases of the photosensitive drums, without waiting for the photosensitive drums 28 to become the reference phases P(0), that is, from the arbitrary phases.

As described above, in the case of the automatic positional deviation correction, it is possible to simply determine the phases of the photosensitive drums 28 at the start timing of the exposing of the first patch data, as the reference phases P(0), and then perform exposure-timing correction based on the relative phases from the reference phases P(0). Therefore, unlike the manual positional deviation correction, it is unnecessary to perform test pattern formation and the next printing according to the reference phases P(0). In other words, since the exposure line scan time is just finely adjusted according to the relative phases from the reference phases P(0), it is possible to accurately perform exposure timing correction, that is, print position correction, without a variation.

An image forming apparatus according to the aspect of the disclosure includes:

a plurality of rotators;

a drive motor configured to drive the plurality of rotators and including a hall element configured to output a hall signal according to a change of a magnetic field;

a counter configured to count the hall signal;

an image forming unit configured to form an image on a recording medium by transferring a plurality of color images from the plurality of rotators to the recording medium; and a controller configured to function as:

an acquiring unit configured to control the image forming unit such that a test pattern is formed on the recording medium, and acquire correction information for correcting a positional deviation of the plurality of color images, based on information of the formed test pattern;

a phase managing unit configured to set phases of the plurality of rotators at a formation start timing of the test pattern, as reference phases, and manage the phases of the plurality of rotators based on a count value of the counter from the formation start timing; and a correcting unit configured to correct the positional deviation based on the phases which are managed by the phase managing unit, and the correction information acquired by the acquiring unit.

According to the present disclosure, when a positional deviation of an image to be formed is corrected based on the test pattern, it is possible to manage the phases of the rotators (the relative positions of the rotators) based on the count value of the count unit from the formation start timing of the test pattern, that is, the count number of the hall signal, without using dedicated sensors. Therefore, it is possible to reduce dedicated sensors for detecting the reference positions of the rotators.

In a case where the count value of the counter is not a count value corresponding to one revolution of the rotator when the image forming unit starts image formation, the phase managing unit may rotate the drive motor until the count value becomes the count value corresponding to one revolution of the rotators, and control the image forming unit to start the image formation at a timing when the count value becomes the count value corresponding to one revolution of the rotator.

According to the present disclosure, it is possible to start image formation from the same places of the rotators based on the count number of the hall signal, without using dedicated sensors for detecting the reference positions of the rotators. Therefore, it is also possible to appropriately correct a positional deviation by the correcting unit, without using dedicated sensors.

The phase managing unit may reset the count value at a timing when the count value becomes a count value corresponding to an integer multiple of one revolution of the rotators, and controls the image forming unit to start the image formation.

According to the present disclosure, it is possible to perform image formation in sync with the rotation periods of the rotators.

The image forming apparatus may further include a storage unit configured to store an output period of the hall signal. The controller may be configured to further function as:

an updating unit configured to update the output period stored in the storage unit for every output; and a determining unit configured to determine that in a case where the output period updated by the updating unit is shorter than the output period stored in the storage unit when the drive motor is to be stopped rotating, the drive motor has rotated reversely, and decrease the count value with respect to an output which is detected after the updating.

During stopping of the drive motor, the drive motor may suddenly and reversely rotate according to a reaction force from the load side. Also, in general, in a case where the drive motor stops, the period of the hall signal lengthens according to a reduction in the rotation speed. For these reasons, according to the above-mentioned configuration, it is possible to detect reverse rotation of the drive motor from a change in the period during stopping of the drive motor and reflect changes of the phases of the rotators attributable to the reverse rotation to the count value. In other words, it is possible to prevent occurrence of a difference between the phases of the rotators and the count value according to reverse rotation during stopping of the drive motor.

The drive motor may include an FG sensor configured to generate an FG signal having a frequency according to the rotation speed of the drive motor, the frequency of the FG signal may be set to a frequency which is larger than a frequency of the hall signal and does not have the frequency of the hall signal as a common divisor, during constant-speed rotation of the drive motor, the acquiring unit may acquire a reference phase difference pattern from a phase difference between the hall signal and the FG signal in each period of the hall signal in one period of rotation of the drive motor, during formation of the test pattern, the acquiring unit may acquire a phase difference pattern from a phase difference between the hall signal and the FG signal in each period of the hall signal in one period of the rotation of the drive motor, and the phase managing unit may correct the count value according to an amount of deviation of the phase difference pattern during the test pattern formation relative to the reference phase difference pattern.

According to the present disclosure, during stopping of the drive motor, if the drive motor rotates reversely, the phase difference between the hall signal and the FG signal changes. As a result, a deviation occurs between the reference phase difference pattern and the phase difference pattern during formation of the test pattern. Therefore, according to the amount of deviation, the count value of the hall signal is corrected, that is, decreased or increased, whereby it is possible to correct an error of the count value attributable to the reverse rotation of the motor during stopping of the drive motor.

The acquiring unit may acquire correction information of the positional deviation correction by receiving a user input according to information of a paper sheet having the test pattern formed thereon.

According to the present disclosure, in a case where the test pattern is a manual positional deviation correction pattern for allowing the user to correct a positional deviation, it is possible to appropriately correct the positional deviation.

The image forming apparatus may further includes intermediate gears that are provided between the drive motor and the rotators, and rotate the rotators one revolution according to an integer number of revolutions of the drive motor.

According to the present disclosure, in general, the count number of the hall signal is an integer multiple of the number of revolutions of the drive motor. For this reason, the intermediate gears are provided to rotate revolutions of an integer multiple of the number of revolutions of the drive motor, thereby rotating the rotators one revolution, whereby it is possible to harmonize the count number of the hall signal and one revolution of each rotator. In other words, the count number of the hall signal is managed, whereby it is possible to precisely manage the phases of the rotators using the phases of the rotators at the formation start timing of the test pattern as the reference phases.

According to the present disclosure, it is possible to reduce dedicated sensors for detecting the reference positions of the rotators.

What is claimed is:

1. An image forming apparatus comprising:

an image forming unit configured to form an image on a sheet by transferring the first color image and the second color image on the sheet, the image forming unit including:

a first drum configured to carry a toner image;

a second drum configured to carry a toner image;

a first developer configured to generate a first color toner image on the first drum; and a second developer configured to generate a second color toner image on the second drum;

a motor including a shaft outputting a torque and a signal generator configured to output a signal every predetermined rotational angle of the shaft; and a transmitting device configured to transmit the torque from the motor to the first and second drums; and a controller configured to include a counter configured to increment a value held in the counter when receiving the signal from the signal generator, wherein when the value held in the counter reaches a predetermined value, the value stored in the memory is reset to an initial value.

2. The image forming apparatus according to claim 1, wherein the transmitting device is configured to transmit the torque of the motor to the first drum and the second drum so that the first drum and the second drum rotate once when the shaft of the motor rotates a plurality of times, and the controller resets the value held in the counter to the initial value when the value incremented by a value increased from the initial value reaches a value corresponding to one rotation of the first drum and the second drum.

3. The image forming apparatus according to claim 1, wherein the controller resets the value held in the counter to the initial value when the image forming unit starts forming the image.

4. The image forming apparatus according to claim 1, wherein the controller resets the value held in the counter to the initial value when a positional deviation correction for correcting deviation between the first color toner image and the second color toner image which are transferred on the sheet.

5. The image forming apparatus according to claim 1, wherein the motor is a DC brushless motor, and the signal generator includes a Hall-effect sensor configured to detect a rotational angle of a rotor of the DC brushless motor.

6. The image forming apparatus according to claim 1, wherein the controller causes the image forming unit to form a test chart on the sheet after the value of the counter is reset, and the controller causes the counter to hold the value at a time when formation of the test chart is completed.

7. The image forming apparatus according to claim 6, wherein the controller rotate the motor when receiving a command of forming the test chart, and at the same time when the motor is rotated, the controller increment the value held in the counter from the value of the counter at the time when formation of the test chart is completed.

8. The image forming apparatus according to claim 6, wherein the controller rotates the motor when receiving a print job, and at the same time when the motor is rotated, the controller increment the value held in the counter from the value of the counter at the time when formation of the test chart is completed.

9. The image forming apparatus according to claim 8, wherein the controller reset the value of the counter to an initial value and causes the image forming unit to form an image based on the print job when the value of the counter becomes a predetermined value after at least one of the first drum and the second dram rotates one revolution.

* * * * *